United States Patent [19]

Willcox

[11] Patent Number: 4,480,932

[45] Date of Patent: Nov. 6, 1984

[54] KEYBOARD HAVING ROTATIONALLY POSITIONABLE INDICIA FOR INDICATING TYPE FONT IN USE

[76] Inventor: Frederick P. Willcox, 565 Oenoke Ridge, New Canaan, Conn. 06840

[21] Appl. No.: 422,936

[22] Filed: Sep. 24, 1982

[51] Int. Cl.[3] ..... B41J 3/54; B41J 1/56

[52] U.S. Cl. ..... 400/82; 400/151; 400/171; 400/172; 400/485; 400/490; 400/493; 340/365 VL; 200/308

[58] Field of Search ..... 400/485, 486, 493, 493.1, 400/493.2, 490, 82, 149, 150, 171, 472, 151; 200/308; 340/365 VL

[56] References Cited

U.S. PATENT DOCUMENTS

| | | | |
|---|---|---|---|
| 1,653,683 | 12/1927 | Whitaker | 400/490 X |
| 3,517,792 | 6/1970 | Abrahamsen | 400/485 |
| 3,879,722 | 4/1975 | Knowlton | 340/324 R |
| 3,892,303 | 7/1975 | Willcox | 400/171 |
| 4,208,140 | 6/1980 | Bucknam | 400/171 |
| 4,313,685 | 2/1982 | Stahl et al. | 400/479 |

FOREIGN PATENT DOCUMENTS

| | | | |
|---|---|---|---|
| 1080126 | 10/1960 | Fed. Rep. of Germany | 400/485 |

OTHER PUBLICATIONS

"Quick Changeable Keytop Indicia"; D. L. Potak; *IBM Technical Disclosure Bulletin;* vol. 12, No, 4, p. 662; Sep. 1969.

"Liquid Crystal Keyboard"; Joseph Stephany et al.; *Xerox Disclosure Journal;* vol. 5, No. 5, p. 559, Sep./Oct. 1980.

*Primary Examiner*—Edgar S. Burr
*Assistant Examiner*—David A. Wiecking
*Attorney, Agent, or Firm*—William D. Hall

[57] ABSTRACT

A keyboard input device for printers, composing apparatus, or clear text display devices which employ type fonts that can be changed at will, has a group of multiple indicia bearing keys which can be positioned to bring a different set of indicia to a readable position to indicate to the operator the character make-up of the type font being used. Both manual and electrical mechanisms are provided to effect indicia positioning. Mechanism is also provided to interconnect indicia selection with either manual or automatic type font selection and changing. Each key operates an electrical switch which is connected to a diode matrix to provide coded output to the device under control.

1 Claim, 3 Drawing Figures

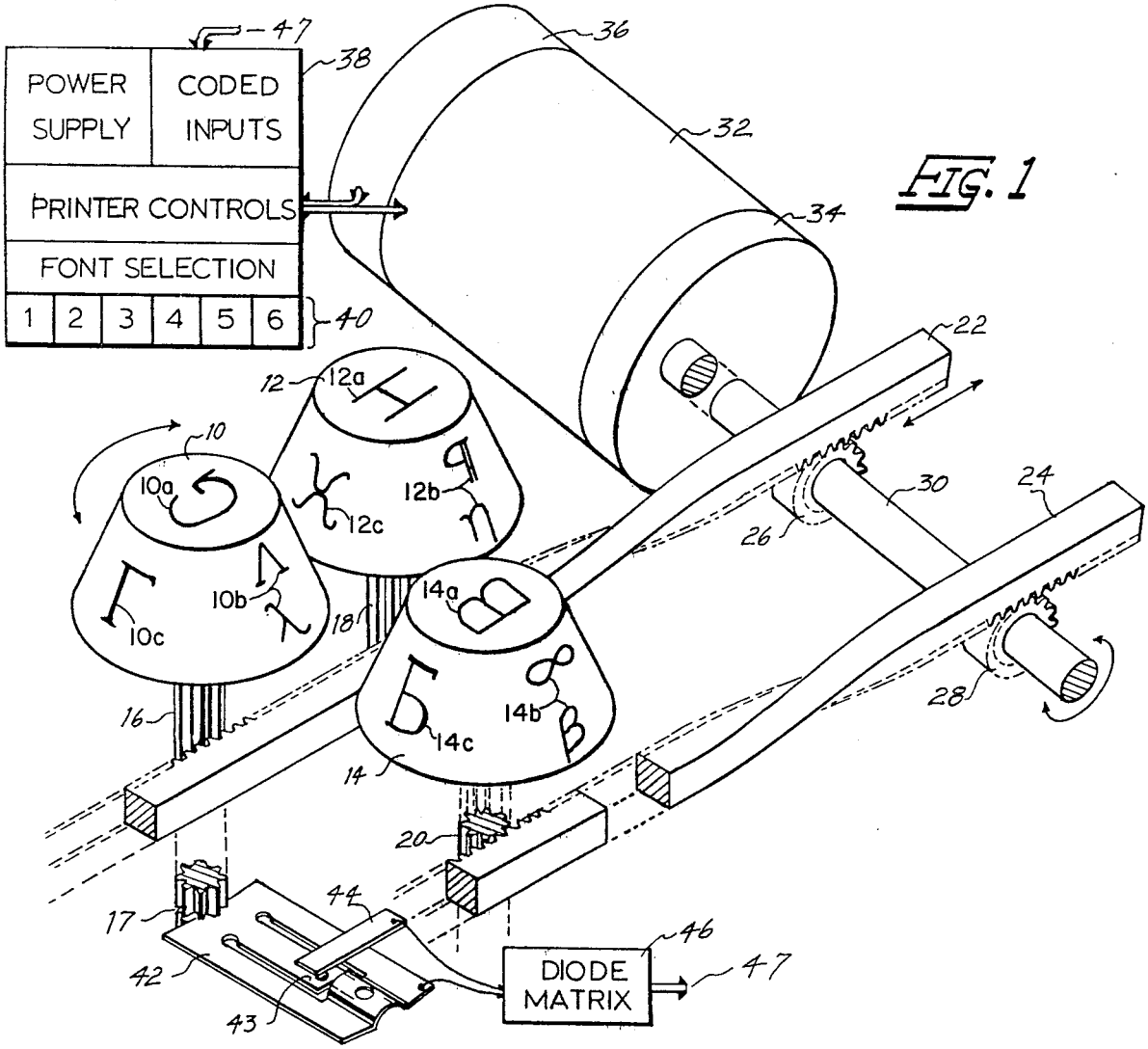
FIG. 1
FIG. 2
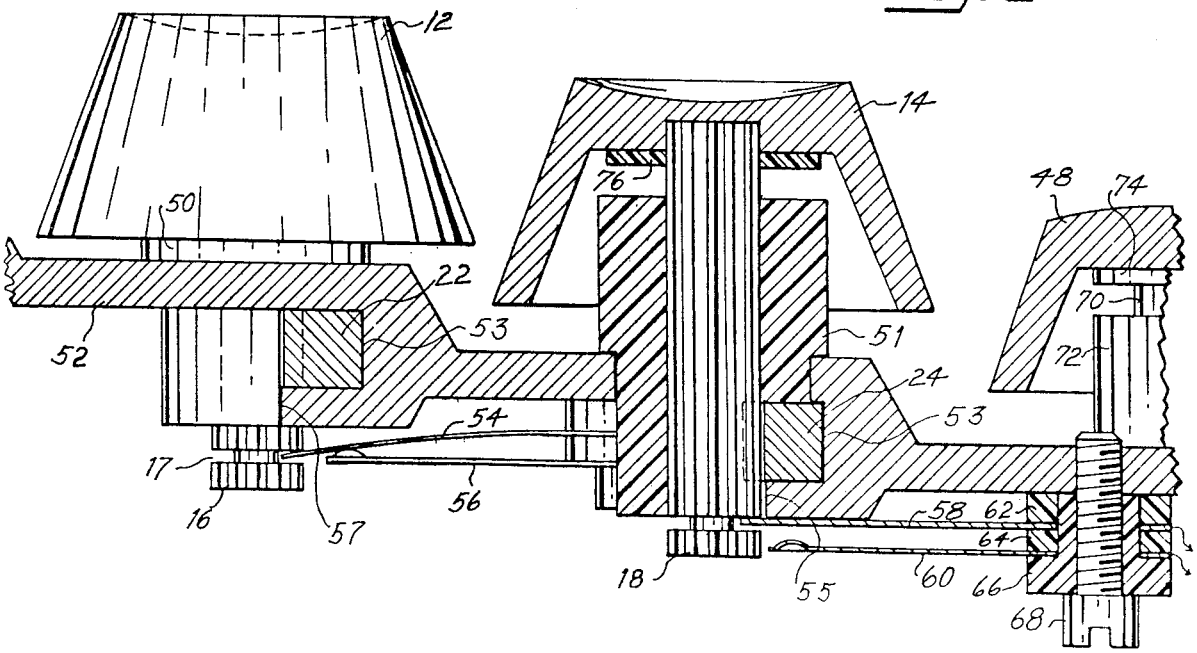

KEYBOARD HAVING ROTATIONALLY POSITIONABLE INDICIA FOR INDICATING TYPE FONT IN USE

SUMMARY

The keyboard input device of this invention has a group of keys, each bearing the respective character defining indicia of two or more type fonts that have different character make-ups. Each key is supported for rotation about a generally vertical axis and all keys of the group can be simultaneously rotated to bring the desired indicia to a position where they are conveniently readable by the operator. The key cap or top portion of each key is mounted on a gear toothed plunger which may be made from a short piece of pinion wire for example. For a conventional four row, typewriter-like keyboard, four parallel toothed racks engage the toothed plungers in the respective rows of keys. The racks are geared or otherwise connected together for back and forth sliding movement to effect key rotation. The racks are either manually or electrically operated.

When the keyboard is fitted to a printer having a type font changing mechanism, indicia selection is either mechanically or electrically interconnected with the mechanism for type font selection and changing so that both indicia and type font selection can be manually effected by one motion, or so that indicia selection, type font selection, and type font changing can be carried out by a sequence of operations initiated by a key or switch designating the type font desired. The entire operation can take place in seconds and thus facilitate the use of many different type fonts in text composition.

The plungers of each of the keys bearing character defining indicia, as well as other keys on the keyboard, operate respective electrical switches which can be connected through a diode matrix to code the output for control of the printer or other apparatus.

DESCRIPTION OF THE DRAWINGS

FIG. 1 is a partial isometric schematic of a keyboard input device incorporating rotatable keys and the mechanism to simultaneously rotate the keys to bring a different set of indicia to the front of the keyboard for viewing. One type of electrical switch is also shown.

FIG. 2 is a partial left side elevation cross-section through the keyboard showing how the keys and rotating mechanism are supported.

DESCRIPTION OF THE INVENTION

Figure 3:
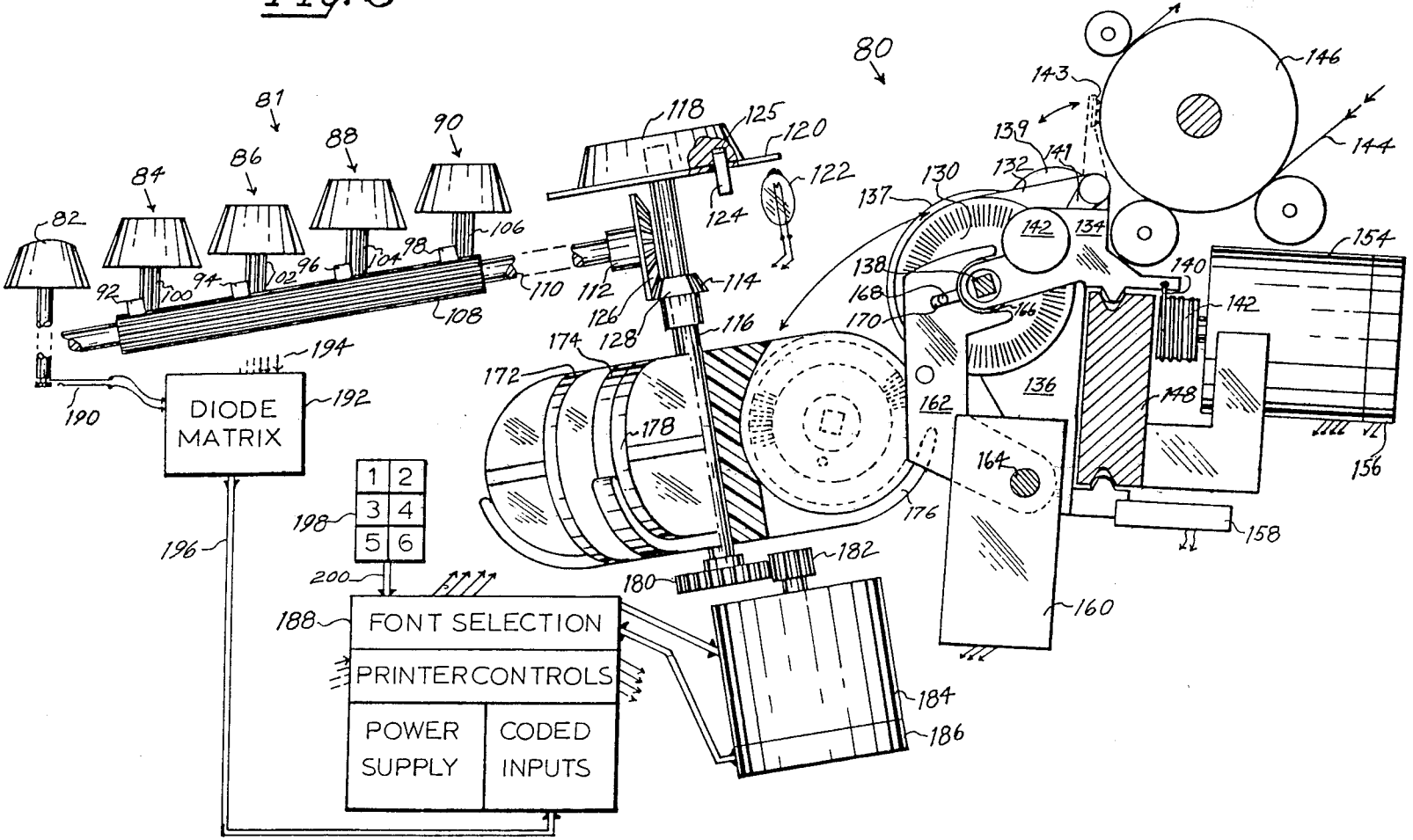
FIG. 3 is a right side schematic elevation of a printer which has a mechanism for exchanging type fonts, a keyboard with rotatable keys, and a font storage and selection mechanism inter-connected for conjoint operation.

This invention can be used with the inventions described in my U.S. Patents:

Reference A: U.S. Pat. No. 3,892,303 July 1, 1975, Type Font Changing Mechanism and Controls;

Reference B; U.S. Pat. No. 3,388,226 June 11, 1968, Pulse Generating Keyboard Contact Switch; and Reference C; U.S. Pat. No. 3,731,778 May 8, 1973, Printer Having Individual Character chips;

which can be refered to for further detail in relation to this disclosure and are incorporated herein by reference.

FIG. 1 shows the essential elements of a novel keyboard having a mechanism for rotating a group of keys in unison to bring a different set of character defining indicia into position for the operator to view and read the make-up of the type font being used. Three keys, indicated at 10, 12, and 14, of a typical large plurality of keys, are respectively supported for rotation on vertically sliding plungers made of short pieces of pinion wire as indicated at 16, 18, and 20. Plungers 16 and 18 are engaged for rotation by a toothed rack 22. Plunger 20 of another row of keys is similarly engaged by rack 24. The other two rows of keys in a typical keyboard would be supported in like position for rotation by respective racks.

Keys 10, 12, and 14 have respective standard character indentifying indicia 10*a*, 12*a*, and 14*a* on their top surfaces. To the forefront on the key cap skirts are respective indicia 10*b*, 12*b*, and 14*b* which are part of a set of indicia identifying the characters in a "symbol" type font typically used for typing technical text. Also shown for example, are possible indicia 10*c*, 12*c*, and 14*c* of a further set identifying character make-up of a foreign character type font. From a practical standpoint, as many as eight to ten different indicia could be arranged around the edge or skirt of each key. If the keys have a cap portion with little or no skirt, the extra sets of character defining indicia markings would be distributed around the larger centrally located markings on the top of each key.

Inasmuch as this keyboard construction is primarily intended for use in a printer having type font storage, selection, and changing mechanisms as shown in Reference A patent, an electrically controlled positioning device is preferred to effect simultaneously rotation of the keys when a type font with a different character make-up is selected. Racks 22 and 24 of a probable plurality of four are engaged respectively by gears 26 and 28 which are fixed on shaft 30. Shaft 30 is rotated back and forth by stepping motor 32 operating through a geared head 34. Motor 32 is fitted with a combined shaft position encoder and commutator 36 to provide feedback and both are connected to the electrical circuitry and control system 38 of the printer.

A group of switches 40, six in this example, are used to effect selection of different type fonts through the font selection means of system 38. For example, if the printer has a type font magazine storage capacity of six different type font units as shown in FIGS. 4 and 5 of Reference A, switches 1, 2, and 3 could be assigned to three conventionally arranged 10, 12, and 14 point type fonts stored in the magazine. Switch 4 could be assigned to a type font made up of mathematical symbols and letters, switch 5 could be assigned to a Russian alphabet type font, and switch 6 assigned to some other type font. Now if switches 1, 2, and 3 are operated to effect selection of the proper type font, the respective font is selected but the keys would not be positioned or rotated thus leaving the conventional set of indicia on the keys facing the operator. If switch 4 is operated, the font selection control would effect selection of the "symbol" type font and, through printer controls system 38, motor 32 would be operated to rotate the keys to bring the "symbol" indicia to the forefront as shown in FIG. 1. The switches 40 can, of course, be part of a group of non-printing function control keys on the keyboard.

Each key of the keyboard is arranged to operate an electrical switch as shown in FIG. 1. For illustration, a single contact, snap action switch of the type shown and described in detail in the Reference B patent is indicated at 42. The free or distal end of switch spring 42 engages a circumferential groove 17 in plunger 16 and retains the key in the keyboard support. When key 10 is depressed, spring 42 bows downward and tongue 43 snaps upward to momentarily make contact with strip 44. Both spring 42 and strip 44 are electrically connected to a diode matrix 46 which codes the electrical impulse into the proper bit code. The matrix output is connected by cable 47 to the coded inputs section of system 38.

From a practical construction standpoint, the short pieces of pinion wire making up plungers 16, 18, and 20 would nominally have no more than eight teeth to keep the outside diameter small for good guiding in the respective supports. A non-standard diametral pitch would preferably be selected so that uniform angular orientation can be had for each plunger and its top member to facilitate manufacture. Gears 26 and 28 are desirably constructed with more than eight teeth so that shaft 30 can be large enough to have adequate bending and torsional stiffness. This means, of course, that shaft 30 never goes through a complete rotation. To simplify construction, racks 22 and 24 have the righthand ends twisted so that the gear teeth cut along one edge can engage the gears as well as the plungers. Thus if the keyboard is inclined at an angle of 10° the ends of the racks would be twisted 80° to properly mate with the respective gears.

The partial cross-section view of FIG. 2 shows how each key is constructed and supported. Key 12 in the second row of keys, key 14 in the first row of keys and space bar 48 are shown. The tops or caps of keys 12 and 14 are retained on pinion wire plungers 16 and 18 which, in turn, are supported for sliding and rotation in respective bushings 50 and 51. These bushings are fixed into the keyboard supporting plate or frame 52. Racks 22 and 24 are supported for back and forth sliding in longitudinal grooves 53 cut or formed in the underside of frame 52. The bottom walls of grooves 53 extend to fully support the racks as indicated by groove edge 57. The side view of bushing 50 shows how the lower part of bushing 50 is cut away on one side to clear the rack 22 and is aligned by groove edge 57.

As also shown in FIG. 2, the keyboard keys such as 12 and 14 are retained in their respective bushings 50 and 51 by the respective leaf springs 54 and 58 which are part of a simpler switch construction than that shown in FIG. 1. Springs 54 and 58 can be transversely bowed to make them into snap action springs. When a key, such as key 12, is depressed, spring 54 makes contact with the second switch member contact strip 56. The cross-section through the switch for key 14 shows how its spring 58 and respective contact strip 60 are insulated from each other by washers 62 and 64 and are supported on insulating bushing 66 which is retained on the bottom of frame 52 by a screw 68 or other means. To accomodate the third row of keys, which are one-quarter spaced from the second row of keys in a conventional keyboard spacing, the switch members are mounted at an angle to the long axis of frame 52 to clear the bushings and plungers of the second row. The fourth row of keys is, of course, alternately or one-half spaced to the third row.

The space bar 48 is fitted with one or more plungers 70 which slide up and down in bushings 72 which are also fitted to frame 52. The plungers of both space bar 48 and the keys such as 12 and 14 are preferably fitted with resilient shock washers as indicated at 74 and 76 which absorb any shock when the key is fully and forcibly depressed. One plunger 70 of the space bar 48 operates a switch which is connected to the diode matrix 46.

In the preferred form of construction, contact strips 44 in FIG. 1, or strips 56 and 60 in FIG. 2, would be the "hot" or continuously energized positive voltage contact. If the pinion wires such as plungers 16, 18, and 20 are made of metal, the tops of the respective keys would be made of a moulded plastic material or otherwise insulated from the pinion wires. To avoid further grounding of switch springs such as 42, 54, or 58, shaft 30 and motor 32 would also be insulated from the machine frame. If the keyboard frame 52 is fabricated from an extruded aluminum alloy, it would be heavy anodized for surface insulation to prevent any sneak circuits. Gears 26 and 28 could be supported on insulating bushings on shaft 30, or could be made of plastic.

Referring now to FIG. 3 showing the right side of a printer, generally designated by the numeral 80, which has a mechanism for storing and changing type fonts, a keyboard of the type shown in FIGS. 1 and 2 is indicated by the numeral 81. Keyboard 81 has a space bar 82 and four rows of keys 84, 86, 88, and 90 which are rotated for indicia shifting by respective racks 92, 94, 96, and 98 which engage the toothed plungers such as 100, 102, 104, and 106 which support their respective key top members as previously described.

The racks 92, 94, 96, and 98 are engaged by a toothed gear 108 which may be a piece of large pinion wire, supported on shaft 110 which has a bevel gear 112 on its inner or righthand end. A smaller bevel gear 114 fixed to shaft 116 meshes with gear 112. The entire assembly can be rotated by the font selection knob 118 on the upper end of shaft 116. Knob 118 has a transparent ring 120 which bears numerals or other font designations. When knob 118 is turned, the selected font designation is illuminated by lamp 122. Knob 118 has its rotation limited by a pin 124 which engages an annular groove 125 in the underside of the knob. Shaft 116 can also be coupled to a magazine for storing type fonts as shown and to be described.

Assuming the use of six different type fonts as described in the example cited for FIG. 1, gears 112 and 114 have respective interrupted tooth portions 126 and 128 so that knob 118 can be rotated to indicate the selection of one of three standard type fonts without shifting or rotating the keyboard indicia. Further rotation of knob 118 would then cause the keys to rotate to indicate the type font selected. While bevel gears with interrupted teeth are schematically indicated in FIG. 3, there are other types of gearing and interrupted angular mechanisms such as Geneva motions and the like which can be combined with gearing to secure the desired combination. Further, if this new keyboard is used with a typewriter that has type fonts that can be changed but no internal storage means, knob 118 could be affixed to the outside or lefthand end of shaft 110 and thus eliminate the gearing. Keys which control non-printing functions would not be connected to the key rotation mechanism.

Printer 80, as shown in FIG. 3, is of the type shown and described in greater detail in the Reference A patent. The type chip font drum 130 is the type shown and fescribed in detail in the Reference C patent. Drum 130 is retained between walls 132 and 134 of print carriage 136 which is positioned along a carriage support bar 148 by a stepping motor 154 which has a cable drum 142. Cable 140 wraps around the cable drum 142 and has one end directly connected to carriage 136, with the other end going around a pulley, not shown, at the left side of printer 80 and then back to connect to carriage 136. Stepping motor 154 has a shaft position encoder and commutator 156 which, along with motor 154, are connected to the printer's electrical control system 188.

Font drum 130 is supported for rotation on square shaft 138 which is driven by another stepping motor 137 located on the left side of printer 80. Motor 137 is also fitted with a shaft position encoder and commutator and both are connected to the electrical system 188. When a coded input signal to select and print a character is received in the printer controls from a keyboard or an external source, motor 137 rotates font drum 130 to bring the selected type chip in line with the chip injector solenoid 142 and with the chip holding end of printing arm 141. The selected type chip is then injected into arm 141 by solenoid 142. Then a rotary solenoid 139 drives arm 141 through an arc as indicated and up to the dotted line position shown to effect imprinting by chip 143 on record material 144 which is supported on rotary platen 146. Arm 141 is then returned to its rest position, solid line, and a spring and plunger or further solenoid on the left side of carriage 136 ejects the type chip from arm 141 and back into font drum 130, all as shown and described in further detail in References A and C.

As further shown in FIG. 3, a font drum storage magazine 172, having a capacity of six different type font drums is supported on shaft 116 for either manual rotation by knob 118 or by an electrical mechanism. A gear 180 on the lower end of shaft 116 meshes with a pinion 182 on stepping motor 184. Motor 184 also has an encoder-commutator 186 and both are connected to the electrical control system 188.

Each key of keyboard 81, such as space bar 82, has an electrical switch 190 which may be of the type described for either FIG. 1 or FIG. 2, connected by wires 194 to a diode matrix 192 which codes the electrical impulses from the various key switches. The matrix 192 is connected to the coded input section of control system 188 by cable 196. Additional non-printing function keys or switches 198 are used to effect electrical operation of both the type font changing sequence and keyboard indicia selection and are connected by cable 200 to the font selection section of control system 188.

Referring further to FIG. 3, a complete interconnected sequence of operations to effect indicia shifting by key rotation, type font selection, and type font changing will now be described. Assuming that one of keys 198 has been depressed to indicate the choice of a type font which is completely different from font drum 130 for example, which is in operating position in printer 80, the first operational sequence is as follows: the character selection part of printer controls section of system 188 effects rotation of font drum 130 by motor 137 to a "home" position so that pin 168 in the back of drum 130 can enter slot 170 in font transfer arm 162. Second, carriage 136 is moved by motor 154 to its extreme righthand position against limit stop and switch 158. As carriage 136 approaches the limit stop, font drum 130 slides off the end of shaft 138 as drum hub 166 enters the forked upper end of arm 162. Third, arm 162, which is supported on shaft 164 for limited angular movement, is rotated counterclockwise by an electromagnetic actuator 160 and transfers drum 130 to the dotted line position shown in magazine 172 where it is retained in position by an integral spring portion 176 of magazine 172. Transfer arm 162 continues its rotation until the forked end clears the bottom of magazine 172.

In the fourth operation of this sequence, the storage magazine 172 is then rotated in the proper direction by motor 184 to bring a selected font drum such as drum 174 into position for pickup by arm 162. At the same time as magazine 172 is being rotated, the rotatable keys of keyboard 81 are rotated to bring the proper indicia set, which define the character make-up of drum 174, into a position readable by the operator.

In the fifth operation of the sequence, arm 162 is rotated clockwise by electromagnetic actuator 160 to pickup the selected font drum 174 and carry it up to the carriage. When arm 162 reaches its upper position as shown, the sixth and last operation of the sequence takes place. The control system 188 effects movement of the carriage 136 away from the limit stop and switch 158 and sliding the selected font drum onto shaft 138. If the printer is fitted with a last typed position memory as shown and described in the Reference A patent, carriage 136 continues to move until it reaches the position at which font exchange was initiated. Printing is then resumed.

If manual operation is to be used to accomplish a similar sequence, a knob or lever is fitted to shaft 164 for hand use in conjunction with hand use of knob 118 for indicia and font selection. Obviously, at the beginning of a manual sequence, rotation of the installed font drum such as drum 130 to its "home" position and movement of the carriage 136 to the limit stop 158 must be initiated by depressing the proper keys on the keyboard.

While only one general form of the invention of a keyboard with rotatable keys and its interconnection with a type font changing mechanism has been shown and described, other detailed arrangements can be constructed by one skilled in the art of printer design without departing from the spirit of the invention. For example, the tops of the keys could be essentially flat and the various character defining indicia displayed through a respective piece of lenticular film so that only one indicia at a time could be seen and read. Likewise, the skirts of the key tops or caps could be translucent or transparent and piped light could be used to illuminate the selected indicia markings. Further, arrangements of cables and pulleys or other devices could be used to rotate the keys in lieu of racks and pinions. Obviously other types of electrical switches such as optical, magnetic, capacitative, or multiple pre-coded contact kinds could be employed.

The keyboard of this invention can equally well be used with text composition devices which employ a cathode ray tube display apparatus or laser beam printing. The stored type fonts can easily be electrically stored information which is electrically addressable and selectable for use in text display and/or printing.

I claim to have invented:

1. In an electrically controlled and operative printer having a keyboard with keys and a printing mechanism which employs changeable type fonts, each font comprising a different set of type characters arranged in a given order and carried by a type-carrier, a magazine for storing a plurality of said type-carriers at designated positions in a given order, positioning means for said magazine to select a particular type-carrier, and means for transferring a selected type-carrier to the printing machine, the improvement comprising:

said keys comprising a multiplicity of rotatable keys arranged in rows on said keyboard, means associated with each rotatable key to select a type character when the rotatable key is depressed and to effect printing with the selected type character, each of said rotatable keys having disposed thereon the respective character-defining indicia of at least two selectable sets of indicia, each selectable set defining a character make-up of type characters carried by a type-carrier, said keys further comprising additional keys, each respective to one of said designated positions, further means associated with each set of additional keys to select a type-carrier stored in a designated position in said magazine when the respective additional key is depressed, key rotating means for simultaneously rotating each of said multiplicity of rotatable keys to bring a selected set of indicia into a conveniently readable position, and connecting means, interconnecting said key rotating means with said positioning means, for conjoint operation when a different type-carrier is selected, to position the magazine for transfer of the selected rotary member to the printing magazine, and to bring the set of indicia corresponding to the type characters carried by the type-carrier into a conveniently readable position, said connecting means comprising mating interrupted gears having an interrupted portion corresponding to one or more of said designated positions in said magazine so that one or more different type-carriers which require the same respective character-defining indicia on said rotatable keys can be selected without effecting rotation of the rotatable keys.

* * * * *